United States Patent [19]

Oswald

[11] Patent Number: 4,477,034

[45] Date of Patent: Oct. 16, 1984

[54] THREAD CATCHING STRUCTURE

[75] Inventor: Heinz Oswald, Winterthur, Switzerland

[73] Assignee: Rieter Machine Works, Ltd., Winterthur, Switzerland

[21] Appl. No.: 523,191

[22] Filed: Aug. 15, 1983

[51] Int. Cl.[3] ..... B65H 75/28; B65H 75/32

[52] U.S. Cl. ..... 242/18 PW; 242/18 A; 242/19; 242/35.5 R

[58] Field of Search ..... 242/18 PW, 18 A, 19, 242/25 R, 25 A, 35.5 R, 125, 125.1

[56] References Cited

U.S. PATENT DOCUMENTS 3,801,038 4/1974 Wust ..... 242/19
3,809,326 5/1974 Wust ..... 242/19
3,856,222 12/1974 Wust ..... 242/18 A
4,106,711 8/1978 Oswald et al. ..... 242/19
4,166,587 9/1979 Miller ..... 242/18 A
4,186,890 2/1980 Miller ..... 242/18 A

*Primary Examiner*—Stanley N. Gilreath
*Attorney, Agent, or Firm*—Kenyon & Kenyon

[57] ABSTRACT

The thread catching structure is mounted on a chuck and includes a winding-on surface from which a thread winding may extend into a shaped recess under an overlying projection. The thread catching structure also has a clamping element which presses outwardly under centrifugal force against an underside of the projection to clamp the thread therebetween. Upon a subsequent severing of the thread, the resulting thread tail extending to the break location remains firmly clamped.

20 Claims, 4 Drawing Figures

THREAD CATCHING STRUCTURE

Figure 2:
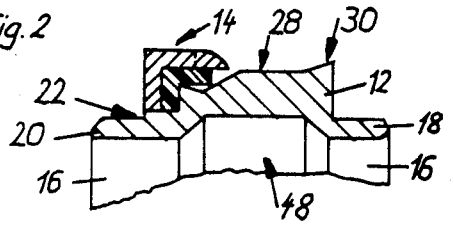

The present application relates to a structure for catching a thread on a chuck of a filament winding machine.

Thread catching structures are now well-known in the filament winding art. An early form of such a structure, and a filament winding machine including such a structure, are shown in British patent specification No. 1332182 corresponding, in part, to U.S. Pat. No. 3,856,222 . Further developments of that structure are shown in U.S. Pat. Nos. 3,801,038 and 4,106,711. From British specification No. 1332182 it will be seen that the filament winding machine comprises a rotatable chuck upon which one or more bobbin tubes can be mounted in use. The bobbin tubes are releasably secured to the chuck for rotation therewith so that a package of yarn is formed in use around each rotating bobbin tube. Other filament winding machines using such chuck structures are shown, for example, in U.S. Pat. No. 4,298,171 and U.S. patent application Ser. No. 412,014 filed Aug. 25, 1982 (corresponding to published European patent application No. 73930). The full disclosures of each of the above-mentioned patent specifications is included in the present specification by reference.

Most frequently, thread catching structures have been built into the chuck, e.g. as shown in U.S. Pat. No. 4,106,711 referred to above. However, it has already been suggested that the structure can be formed separately from the chuck and can be associated with (preferably secured to) a bobbin tube. In particular, it is known from published Japanese patent applications Nos. 32839 of 1976 and 38544 of 1976 to provide a ring structure which is located in use between two adjacent bobbin tubes on a rotatable chuck and has axial projections which extend into the bores at the adjacent ends of those bobbin tubes.

Thread catching structures as shown in the prior art referred to above comprise axially projecting teeth having edges for guiding a thread. It is known from U.S. Pat. No. 4,106,711 that a thread can be clamped against the underside (i.e. against a radially inwardly facing surface) of any one of these teeth. In the disclosure of that specification, clamping is effected by a deformable or movable element which moves outwardly against the underside of its associated tooth under the effect of centrifugal force in use, and which returns radially inwardly of the chuck (to release the thread) as the chuck slows down after completion of winding of a thread package. The arrangement described in the U.S. Pat. has worked well but there are circumstances in which that structure can be modified with advantage.

The present invention relates to a thread catching structure for use on a chuck of a filament winding machine. The structure comprises at least one axially directed projection having an underside facing radially inwardly and a thread guiding edge. The structure further comprises a clamping element for clamping a thread against the underside of the projection. The structure further comprises a guide surface for guiding the thread under the projection.

The element comprises a portion securing the element to the structure. The element further comprises a second portion secured to the first and extending away therefrom. The second portion is pivotable relative to the first to cause a surface on the second portion, spaced from the first portion, to press against the underside of the projection under the influence of centrifugal force acting on the second portion in use. The clamping element is so mounted in the structure that, in the absence of centrifugal force, the second portion is not pressed against the underside of the projection. Preferably a resilient bias tends to move the second portion away from the projection in the absence of centrifugal force.

Normally, the structure is ring-like and comprises a plurality of projections angularly spaced around the structure. The clamping element may then extend continuously around the structure, so as to be capable of engaging the underside of each projection. There could, however, be individual clamping elements associated with respective projections. The guide surface may also extend continuously around the structure, or there may be a plurality of guide surfaces associated with respective projections.

The projection or projections may be formed on a first member and the guide surface or surfaces on a second member and the members may be secured together to form the structure. Each member may be in the form of a ring. Securing of the rings may be effected by passing a portion of one ring member into a receiving bore preferably being provided on the first ring member. Where the structure is made up of first and second ring members, the first portion of the or each clamping element is conveniently secured to the structure by clamping said first portion between the ring members.

Whichever means is chosen to secure the first portion to the structure, the first portion is preferably immovable relative to the structure.

The first and second portions of the or each clamping element are preferably integral with each other, the pivoting movement of the second portion occurring by bending of the second portion and/or its connection with the first portion.

The required pivoting of the second portion is to occur under the action of centrifugal force arising during rotation of the structure on a chuck. The pivot region of the clamping element must be designed accordingly.

The surface which engages the projection is preferably provided at a free edge of second portion remote from the first portion. The surface is preferably radiused to facilitate movements of a thread between the surface and the projection.

The second portion is preferably of such material and so designed, that the surface substantially maintains its shape while pressed against the projection or at least undergoes only minor deformation, to form a controlled clamping zone for the thread.

The structure may have means for connecting it to a bobbin tube, e.g. a tubular portion adapted to project into the bore of a bobbin tube. In a preferred embodiment, the structure is provided with two such means for cooperation with respective ends of adjacent, axially aligned bobbin tubes.

The structure may have a bore arranged to be free sliding fit on the external surface of a chuck of a filament winding machine. The bore of the structure may, however, be provided with means for cooperation with a locating device provided in the chuck. The ring structure can then, for example, provide axial location for one or more bobbin tubes mounted on the chuck in use.

Figure 3:
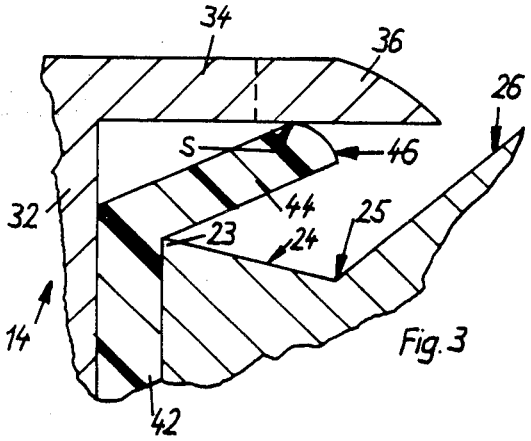
Figure 4:
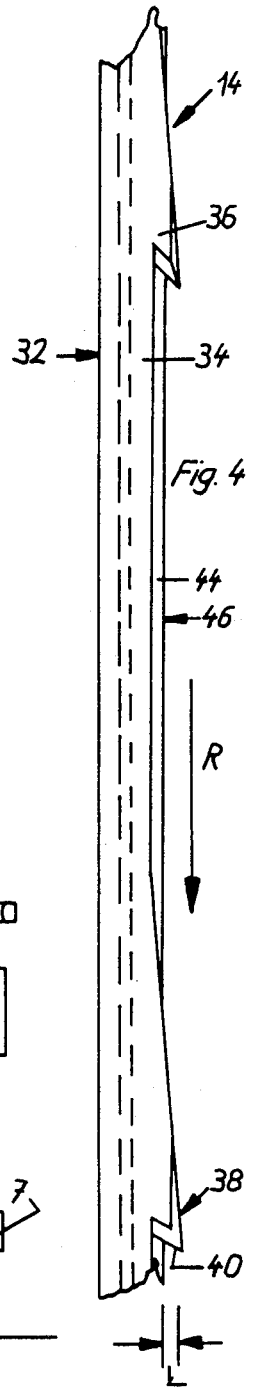
Figure 1:
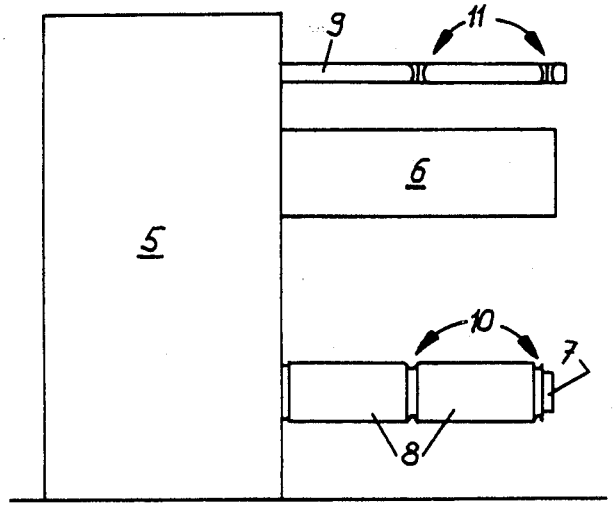

By way of example, one embodiment of the invention and some variations thereof will now be described with reference to the accompanying drawings, in which FIG. 1 shows a diagrammatic side elevation of a filament winding machine with a plurality of structures according to the invention, FIG. 2 shows an axial section through part of a thread catching structure according to the invention, FIG. 3 shows a detail taken from FIG. 1 and drawn to a larger scale, and FIG. 4 shows a developed view of one of the ring members shown in FIG. 2.

FIG. 1 shows diagrammatically the headstock, friction drive roll and chuck of a filament winder, for example of the type shown in U.S. patent application Ser. No. 06/243,922 corresponding with European patent application No. 80901178 published in accordance with the PCT under the No. WO 81/00248. The invention is applicable to other types of winders, for example as referred to in the introduction to this specification.

The headstock shown in FIG. 1 comprises a housing 5 containing various drive and mounting systems (not shown) for the friction drive roll 6 and chuck 7 each of which projects cantileverfashion from the front face of the housing. Chuck 7 is shown in a rest position spaced from roll 6. The chuck carries a pair bobbin tubes 8 on which thread packages are to be formed, for example packages of synthetic filament for industrial application, e.g. tire cord. Since such filament is of substantial strength, respective severing means are associated with the tubes 8, each severing means comprising a thread catching structure 10 which will be described in further detail with reference to the other Figures.

In use, chuck 7 is moved to an operative position in which it is driven into rotation by roll 6. Filaments fed to respective tubes 8 are wound into respective packages thereon, being traversed axially of the tubes by a suitable traverse mechanism (not shown) of well known type, also mounted on and driven from the headstock.

In order to first engage the filaments with the structures 10, the filaments are first laid in respective guide notches 11 in a bar 9 which is movable, by means (not shown) provided in the headstock, axially of the roll 6 and chuck 7. A suitable system is described, by way of example, in British patent No. 1520643. Details of the catching operation will be described with reference to the other Figures.

Two tubes 8 are shown by way of example only. A winding machine of this type can normally be adapted to wind between 1 and 6 filaments simultaneously.

The structure 10 shown in FIG. 2 comprises a first ring member 12 and second ring member 14. Each ring member is in itself an integral body, the two members being secured together as will be described below in order to form the structure.

The cross section of ring member 12 is uniform around the whole periphery of the structure. The innermost surfaces 16 of member 12 lie on an imaginary smooth cylinder, which is dimensioned to provide a free sliding fit on the external surface of chuck 7. At each axial end, member 12 has tubular portions 18 and 20 respectively the external surfaces of which are dimensioned to fit within the bores of bobbin tubes 8.

Immediately adjacent tubular portion 20, member 12 has a low, outwardly extending step 22, the annular, outwardly facing surface of which provides a receiving surface for the member 14 as will be further described below. The portion of member 12 between step 22 and tubular portion 18 is of relatively large radial depth and has a series of outwardly facing surfaces best seen in FIG. 3. Starting from the edge 23 adjacent step 22 this series of surfaces comprises a frusto-conical surface 24 sloping radially inwardly, a frusto-conical surface 26 sloping radially outwardly, a cylindrical surface 28 and a frusto-conical surface 30 sloping radially outwardly. All surfaces of the series are coaxial with the structure with the adjacent frusto-conical surfaces 24, 26 forming an annular recess in the outer surface of the member 12. The radius to surface 28 is longer than the radius to edge 23.

As can be seen from FIGS. 2 and 4 taken together, ring member 14 is of L-shaped cross section, with a longer leg 32 of the L extending radially and a shorter leg 34 of the L extending axially towards surface 26.

The members 12 and 14 fit together with the free end of the longer leg 32 engaging the outwardly facing surface on step 22, preferably being a press fit thereon so that additional securing means (such as screws or a glue) are unnecessary.

As best seen in FIG. 4, leg 34 has a plurality of axially directed projections 36 disposed over the recess defined by the frusto-conical surfaces 24, 26 of the member 12. The axially outermost portions of these projections lie close to but spaced from the surface 26 (FIG. 2), being spaced radially outwards from edge 23. Each projection 36 is of limited angular extent, and the projections are equi-angularly spaced around the periphery of member 14. Each projection 36 is shaped with edges 38, 40 which meet at a point. Similar edges, which are designed for guiding a thread, have been shown and described in the prior U.S. Pat. Nos. 3,801,038 and 4,106,711 referred to above, and accordingly no detailed description of these edges is included in this specification. The direction of rotation of the chuck in use is indicated by the arrow R in FIG. 4.

Mounted between members 12 and 14 is a clamping element comprising a first annular portion 42 and a second annular portion 44. These portions are formed integral with each other in a third ring member. Portion 42 is securely, immovably clamped between leg 32 and the adjacent axially facing surface on ring member 12. The portions are of uniform cross section around their peripheries.

FIG. 3 shows a somewhat idealised arrangement of the parts, which is by no means essential. In any event, the portion 44 of the clamping element projects away from portion 42 through the space left between the underside (radially inner face) of leg 34 and the edge 23. In the preferred arrangement, shown in FIG. 3, with the chuck at rest (FIG. 1), the portion 44 extends slightly radially outwardly from portion 42 towards the undersides of the projections 36. However, this is not essential and, in view of the dimensions involved, may be difficult to achieve. It is perfectly satisfactory to arrange the portion 44 extending substantially axially or even slightly radially inwardly. The frusto-conical surface 24 allows such an arrangement. It will be appreciated, therefore, that manufacturing and assembly tolerances are not critical to the performance of the present thread clamping system.

Portion 44 has a free edge 46 spaced from portion 42. As seen in FIGS. 2, 3 and 4, this edge 46 lies beyond leg 34 (considered relative to leg 32) but the outermost tip of each projection 36 lies beyond the edge 46. The material and the radial thickness of portion 44 are so chosen that, in response to centrifugal force arising during rotation of chuck 7 in use, portion 44 bends about the region of its connection with portion 42 so that a surface S near the free edge 46 is forced against the undersides of the projections 36. Apart from the bending effect, however, the material of portion 44 is designed to retain its shape under the forces applied to it in use so that there is either substantially no deformation or a determinate, small degree of deformation of surface S when it is pressed against the projections 36, whereby a controlled thread clamping zone is produced between portion 44 and the underside of each projection.

During lacing up of the machine (and also during a changeover, if the machine is of the automatic change type shown in U.S. Pat. No. 4,298,171 and European patent application No. 73930), a thread to be wound on a tube 8 is laid on the surface 28 of the structure 10 associated with that tube. A predetermined minimum wrap angle (usually about 30°) is required around the surface 28. As already described, the thread is also guided in its notch 11 (FIG. 1). When bar 9 is moved axially, the thread is moved first along surface 28 and then begins to slide "down" surface 26, that is to move radially inwardly relative to the ring. Ideally, the thread reaches the trough 25 (FIG. 3) of the groove formed between surfaces 24 and 26 and is then intercepted by one of the projections 36. If the projection intercepts the thread before the latter has reached the trough 25, then the inclined edge 40 tends to urge the thread axially into the same direction as guide surface 26.

When the thread is intercepted by the projection 36 it wraps around the projection including the underside thereof. Continued axial movement of bar 9 together with the guiding and urging effect of edge 40 draw the thread into the clamping zone between surface S and the underside of projection 36. In order to facilitate such movement of the thread, surface S preferably has a slight radius or is otherwise formed so that a gradually narrowing gap is presented to the thread as it moves into the clamping zone.

One "end" of the thread loop around the projection 36 is held by the manipulating device (in the case of lacing up—e.g. an aspirator) or by the outgoing package (in the case of a changeover). Eventually, therefore, the tension in the thread loop rises to tearing or breaking point, and the thread is severed between the clamping zone and the manipulating device in the case of lacing up, and between the clamping zone and the full package in the case of a changeover. Due to continued movement of bar 9, the thread being fed to the machine is now transferred from the ring structure onto the bobbin tube and begins to wind into a package thereon in known manner. The "tail" extending to the break location remains firmly clamped between the surface S and the underside of the projection. There is no danger of this tail coming loose and catching in neighbouring equipment.

When the package is complete and the chuck is brought to rest, however, the surface S is no longer forced against the projections. Depending on the exact arrangement of parts, as discussed with reference to FIG. 3, the surface S may or may not actually engage the projection at this stage. Where the initial mounting of the clamping element is such that the portion 44 does not contact the projections when the chuck is at rest, the portion will return to its initial position after each winding operation due to the elasticity of portion 44. Even where the portion continues to contact the projections, however, it will do so with a force which is inadequate to resist withdrawal of the thread tail when the package is removed from the chuck.

The material of the clamping element clearly has to meet several requirements

- it must be elastically deformable, but not unduly so, otherwise the radially unsupported portions between the projections 36 will be damaged during repeated winding operations of modern high speed winders with chuck rotation rates of 6000 m/min
- it must be hard enough to retain its shape at least in and around the surfaces S pressed against the projections; otherwise the portion 44 is simply pressed flat against the underside of each projection and the thread cannot be drawn into the "clamping" zone
- its surface preferably exhibits low friction relative to the thread to facilitate sliding of the thread into the clamping zone.

The ring members 12 and 14 on the other hand can be made of a suitable, preferably light weight, metal alloy.

In the illustrated example, the structure 10 is used between bobbin tubes and at one end of an assembly thereof (FIG. 1) so that the structure can also act as an axial locating means for the tubes. For this purpose, the member 12 has an internal groove 48. A retaining device (not shown) in the chuck 7 cooperates with this groove to retain it axially of the chuck. The retaining device may co-operate with the outboard structure only, or with all structures.

The same principles could be used in a structure designed to be built into the chuck, lying inwardly of the internal diameter of the bobbin tubes. Clearly, there is then no point in providing either the portions 16, 18 or the groove 48.

The location of the free end of portion 44 and of the zone of contact of the portion 44 with the projections 36 are of some importance. The free edge 46 of the portion 44 represents a barrier to movement of the thread beneath the projections. It is therefore preferably substantially aligned axially with the trough 25—at least the edge 46 should not overlie the surface 26 to any significant extent. Thus, a length L of each projection 36 is left free to intercept the thread. This "interception" length L should be adequate to ensure that even a "flattened" thread is fully intercepted. For example, where an individual thread is made up of a large number of individual filaments, the filaments will be spread into a band during movement on the surface 26. The band should recollect to a "bundled" thread in the trough 25. If the length L is made too short, then the projection may intercept only part of a "flattened" thread, possibly resulting in a failure to catch the thread.

The clamping zone is located as close as possible to the interception length L of the projection so that the thread is clamped as soon as possible after interception.

The required minimum interception length L depends upon the thread to be caught, the operating circumstances (for example, the thread tension during the catching operation) and upon the exact design of the structure 10 (for example, the material of the ring member 12 and the inclination of the surface 26). Accordingly, the minimum value of L appropriate to any given set of circumstances must be established empirically.

The inclination of the surface 24 is not essential but has several associated advantages. It forms a clear trough 25 at the innermost radius of the guide surface 26. It ensures adequate space for the portion 44 even if the latter is slightly malformed. Further, it tends to hinder penetration of fibrils into the space radially inwards of the portion 44. The edge 23 of surface 24 does not have to be located at the "knee" between portions 42 and 44 as shown in the drawings, and can advantageously be withdrawn slightly to ensure freedom of part 44 to bend.

The triangular section spaces between the portion 44 and undersides of the projections 36 are also not essential and may be difficult to ensure in practice without undue precautions in manufacture and assembly of the individual parts. Due to the L-section of the clamping element and the secure fixing of the portion 42, the free edge 46 will in any event be pressed harder against the undersides of the projections than zones of portion 44 closer to portion 42. However, the triangular space, if it can be conveniently produced, assists in establishing a clearly defined clamping zone. In any event, the portion 44 must have adequate freedom in relation to the underside of the projections 36 to ensure a significant differential between the contact pressure (if any) in the clamping zone at rest and the contact pressure at operating speed.

The length of portion 44 (and of the associated projections 36) is preferably the minimum possible subject to achievement of the required functions of intercepting and catching the thread, so that "chuck length" is saved for other purposes.

Surface 28 does not have to be precisely cylindrical—in fact, a very small cone angle with the surface 28 tapering in a direction away from the ring member 14 may be desirable to give added control over the movement of the thread in response to movement of bar 9.

It is not essential to extend portion 44 around the whole of the periphery of the structure 10. The portion 42 could carry individual "tabs" associated with respective projections 36. There are however two associated disadvantages—namely, (1) the tabs must then be carefully located relative to the projections to produce clamping zones at or near the edges 40 and (2) the tabs will clearly be weaker than a continuous ring element. It may, however, be advantageous to provide recesses in the edge 46 of portion 44 in the regions lying between the projections 36. Thus, the recessed edge 46 between the projections does not interfere with movement of the thread onto the bobbin tube in response to movement of the bar 9. If the extent of each recess is limited, then the problem of positioning the portion 44 relative to the projections 36 should not prove significant.

The portion 42 also does not have to be continuous around the structure 10. There could be individual clamping elements associated with respective projections, but this would considerably increase manufacturing and assembly problems.

It will be appreciated that portion 42 functions simply as an anchoring part and alternative securing means could be used. In principle, a clamping "lip" or clamping "tabs" could be cast integral with ring member 12, but this would considerably increase manufacturing problems and would result in rejection of the whole ring member upon failure of the lip or a single tab.

Strictly by way of example a detailed design of one structure 10 according to FIG. 2 is given below:

| | |
|---|---|
| Overall axial length of structure | 25 mm |
| Lengths of portions 18 and 20 - each | 4.5 mm |
| Diameter of surfaces 16 | 90.6 mm |
| Diameter of outermost surface of member 14 | 105 mm |
| Axial thickness of leg 32 of member 14 = radial thickness of leg 34 of member 14 | 1.5 mm |
| Axial thickness of portion 42 = radial thickness of portion 44 | 1 mm |
| Material of clamping element | polyoxymethylene plastics (nylon) |
| "Interception"length L | approx. 1 mm. |

This structure was designed for use in a winding machine of the type shown in European patent application No. 73930 for winding polyester filaments in the range up to 300 dtex.

It is not strictly essential to form the thread catching structure 10 as a ring unit, but this is a highly convenient form of structure enabling pre-assembly of the structure itself and convenient assembly of the structure with bobbin tubes or in the chuck.

It is also not strictly essential to arrange the second portion 44 extending away from the first portion in a direction towards the guide surface 26. By altering the location at which the first portion is secured in the structure, the second portion could be made to extend away from the guide surface 26 against the underside of the projections.

I claim:

1. A thread catching ring structure for use on a chuck of a filament winding machine, said ring structure comprising at least one axially directed projection having an underside facing radially inwardly and a thread guiding edge, a guide surface for guiding a thread radially inwardly under the projection and a clamping element for clamping the thread against the underside of the projection, said element comprising a first portion securing the element to the structure and a second portion connected to the first and extending away therefrom, the second portion being pivotable relative to the first portion under the influence of centrifugal force acting thereon in use to cause a surface portion to press against the underside of the projection.

2. A structure as claimed in claim 1 wherein the first and second portions are integral and the second portion is pivotable by bending thereof relative to the first under the influence of centrifugal force in use.

3. A structure as claimed in claim 2 wherein the structure comprises a plurality of projections and each of the first and second portions is ring-shaped.

4. A structure as claimed in claim 3 wherein the clamping element is of uniform cross-section around its circumference.

5. A structure as claimed in claim 1 wherein the first portion is secured to the structure radially inwardly of said projection.

6. A structure as claimed in claim 5 wherein the second portion extends away from the first portion in a direction towards said guide surface.

7. A structure as claimed in claim 1 wherein the projection is formed on a first ring member and the guide surface is formed on a second ring member, the first portion being secured to the structure by clamping it between said ring members.

8. A structure as claimed in claim 1 wherein said surface which engages the underside of the projection is located at or adjacent a free edge of the second portion remote from the first portion.

9. A structure as claimed in claim 8 wherein said surface is radiused.

10. A structure as claimed in claim 1 wherein said surface substantially maintains its shape while pressed against the projections under centrifugal force.

11. A thread catching structure comprising a ring member for mounting on a chuck and having an annular recess in an outer surface;

a first member mounted on said ring member and having at least one axially directed projection disposed over said recess, said projection having an underside and a thread guiding edge for guiding a thread to said underside; and a clamping element having a first portion clamped between said ring member and said first member and a second portion integral with said first portion and extending over said recess between said projection and said recess, said second portion being of a material and thickness to bend outwardly under centrifugal force against said underside of said projection to define a controlled thread clamping zone therebetween.

12. A structure as set forth in claim 11 wherein said second portion has a slightly radiused surface for contacting said underside to define said thread clamping zone.

13. A structure as set forth in claim 11 wherein said clamping element is elastically deformable.

14. A structure as set forth in claim 11 wherein said first member is mounted concentrically on said ring member and has a plurality of said projections theron.

15. A structure as set forth in claim 14 wherein said clamping element is annular in shape and said second portion is spaced from said projections.

16. In a thread catching structure, the combination comprising an annular member having at least one axially directed projection, said projection having an underside and a thread guiding edge for guiding a thread to said underside; and a clamping element having a first portion fixed within said annular member and a second portion integral with said first portion, said second portion being disposed opposite and in spaced relation to said underside of said projection, said second portion being of a material and thickness to bend outwardly under centrifugal force against said underside of said projection to define a controlled thread clamping zone.

17. The combination as set forth in claim 16 wherein said first portion of said clamping element is annular.

18. The combination as set forth in claim 16 wherein said clamping element is annular.

19. The combination as set forth in claim 16 wherein said second portion has a slightly radiused surface for contacting said underside to define said thread clamping zone.

20. The combination as set forth in claim 16 wherein said clamping element is elastically deformable.

* * * * *